US009076411B2

(12) United States Patent
Kim

(10) Patent No.: US 9,076,411 B2
(45) Date of Patent: Jul. 7, 2015

(54) GUITAR STRING REGULATOR

(76) Inventor: Bum-Jin Kim, Seoul (KR)

( * ) Notice: Subject to any disclaimer, the term of this patent is extended or adjusted under 35 U.S.C. 154(b) by 0 days.

(21) Appl. No.: 13/635,327

(22) PCT Filed: Aug. 6, 2012

(86) PCT No.: PCT/KR2012/006224

§ 371 (c)(1),
(2), (4) Date: Sep. 14, 2012

(87) PCT Pub. No.: WO2013/027944

PCT Pub. Date: Feb. 28, 2013

(65) Prior Publication Data

US 2015/0143974 A1 May 28, 2015

(30) Foreign Application Priority Data

Aug. 22, 2011 (KR) ..... 10-2011-0083249

(51) Int. Cl.
*G10D 3/14* (2006.01)

(52) U.S. Cl.
CPC ..... *G10D 3/14* (2013.01)

(58) Field of Classification Search
CPC ..... G10D 3/14
See application file for complete search history.

(56) References Cited

U.S. PATENT DOCUMENTS

| | | | | |
|---|---|---|---|---|
| 2,557,877 | A * | 6/1951 | Kluson | 84/304 |
| 4,452,120 | A * | 6/1984 | Chance et al. | 84/306 |
| 5,505,110 | A * | 4/1996 | Richardson et al. | 84/304 |
| 6,172,287 | B1 * | 1/2001 | Kang | 84/304 |
| 6,608,248 | B1 * | 8/2003 | Sperzel | 84/306 |
| 7,102,065 | B2 * | 9/2006 | Sperzel | 84/304 |
| 7,632,997 | B2 * | 12/2009 | Small et al. | 84/306 |
| 7,842,870 | B2 * | 11/2010 | Box et al. | 84/304 |
| 8,093,475 | B1 * | 1/2012 | Sperzel | 84/312 R |
| 8,153,872 | B1 * | 4/2012 | Ward | 84/297 R |

* cited by examiner

*Primary Examiner* — Robert W Horn
(74) *Attorney, Agent, or Firm* — John K. Park; Park Law Firm

(57) ABSTRACT

A tuning key for guitar strings is provided, which enables the remaining portion of guitar strings which is left after being wound on the tuning key when the guitar strings are hung and set. The tuning key for guitar strings comprises a tuning peg on which a worm gear portion is arranged at one side, a coupling body in which a male screw portion is formed, a casing in which a bearing portion is formed, a rotary rod in which a spur gear is arranged, and a nut coupled to the male screw portion of the casing and fixes the casing from a head, wherein tuning keys for guitar strings are provided in the head, and a through-hole through which the remaining portion of guitar strings wound on a winding portion is penetrated and arranged is formed in the center of the rotary rod.

2 Claims, 4 Drawing Sheets

GUITAR STRING REGULATOR

TECHNICAL FIELD

The present invention relates to a guitar string regulator, and more particularly, to a guitar string regulator, which is capable of cleanly arranging the remainder of strings after strings of the guitar are set so as to prevent interference among the strings and prevent a player from being injured by ends of the strings.

BACKGROUND ART

As people know, guitars are the most popularized out of string instruments, and FIG. 1 illustrates an example of the guitar.

The guitar 1 includes a bridge 3 disposed at a sound box 2, a fingerboard 4 combined from the sound box 2, a head 5 disposed at one side of the fingerboard 4, and a guitar string regulator 10 mounted on the head 5 for regulating strings (W).

The guitar string regulator 10 is a device for tuning pitch of each string by regulating tension force of the guitar strings in a state where front and rear ends of the guitar strings are fixed. As shown in FIG. 2, the guitar string regulator 10 is mounted on the head 5 of the guitar 1 and includes: a regulating lever 12 having a worm gear part 11 disposed at one side thereof; a casing 14 having a joining tube 14*b*, which has a male screw portion 14*a* penetrating through the head 5, and a bearing portion 14*c* formed on a lower portion thereof for receiving the worm gear part 11 and supporting rotation of the worm gear part 11; a rotational rod 15 penetrating through the casing 14 and having a winding portion 15*a*, which is concavely formed at one side thereof for winding a string, a guide hole 15*b*, which is formed in the winding portion 15 and penetrates through the joining tube 14*b* for inserting the string W thereinto, and a spur gear 15*c*, which is disposed at a lower portion thereof for rotating the rotational rod 15 in engagement with the worm gear part 11; and a nut 16 joined to the male screw portion 14*a* of the casing 14 for fixing the casing 14 from the head 5.

According to the guitar string regulator 10 having the above structure, when the string W penetrates into the guide hole 15*b* of the rotational rod 15 and the regulating lever 12 is rotated, the spur gear 15 is rotated by the worm gear part 11 and the rotational rod 15 is rotated by the spur gear 15*c*, and then, the string 15*a* is wound on the winding portion 15*a* while tension force is applied to the string.

The remainder of the string W wound on the winding portion 15*a* is left as it is or is wound up on the tensed string twice or three times within a section of the head 5 before a start of the fingerboard and cut by a nipper.

However, the method of winding up the remainder of the string on the tensed string influences on the twangy tone of the string, the remainder of the string must be cut by the nipper as close as possible.

In the majority of cases, when the string is forcedly cut, because the end portion of the string gets sharp, the player frequently gets pricked or scratched while handling the head of the guitar or the case for receiving the guitar or playing the guitar.

As described above, because the guitar strings are made of high carbon steel, it is not easy to cut them and the player has to pay attention due to the sharp cut portion of the string.

DISCLOSURE

Technical Problem

Accordingly, the present invention has been made in an effort to solve the above-mentioned problems occurring in the prior arts, and it is an object of the present invention to provide a guitar string regulator, which is capable of cleanly arranging the remainder of strings after strings of the guitar are set so as to prevent interference among the strings and prevent a player from being injured by ends of the strings.

Technical Solution

To achieve the above objects, the present invention provides a plurality of guitar string regulators, which are mounted on a head of a guitar, and each of which includes: a regulating lever having a worm gear part disposed at one side thereof; a casing having a joining tube, which has a male screw portion penetrating through the head, and a bearing portion formed on a lower portion thereof for receiving the worm gear part and supporting rotation of the worm gear part; a rotational rod penetrating through the casing and having a winding portion, which is concavely formed at one side thereof for winding a string, a guide hole, which is formed in the winding portion and penetrates through the joining tube for inserting the string thereinto, and a spur gear, which is disposed at a lower portion thereof for rotating the rotational rod in engagement with the worm gear part; and a nut joined to the male screw portion of the casing for fixing the casing from the head, wherein the rotational rod has a through hole formed at the center of the rotational rod for inserting the remainder of the string wound on the winding portion thereinto.

Moreover, the through hole is twice the diameter of the guide hole such that the remainder of the string inserted into the through hole is intersected relative to the string inserted into the guide hole of the winding portion.

Advantageous Effects

As described above, the guitar string regulator according to the present invention can prevent interference by the cut end of the string, prevent the player from getting scratched or pricked by the cut end of the string, and can always make the head part of the guitar clean because the cut end of the string of the guitar is guided into the through hole formed in the rotational rod as soon as the string is cut close below the case after the remainder of the string penetrates through the through hole of the rotational rod.

MODE FOR INVENTION

Figure 1:
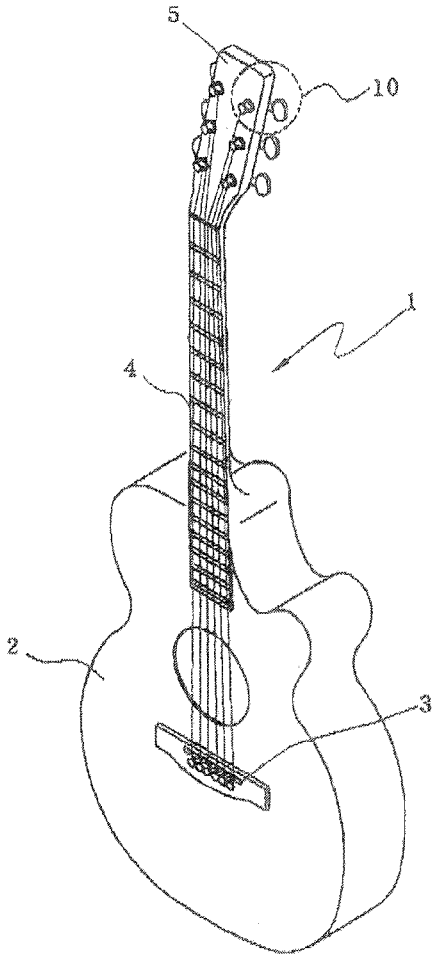
FIG. 1 is a perspective view of a general acoustic guitar.
Figure 2:
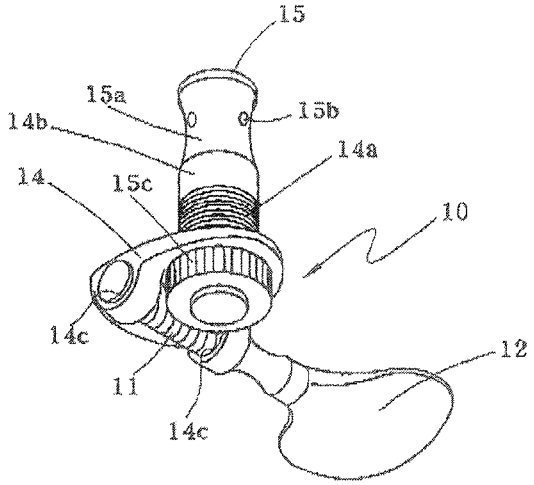
FIG. 2 is a perspective view of a guitar string regulator according to a prior art.
Figure 3:
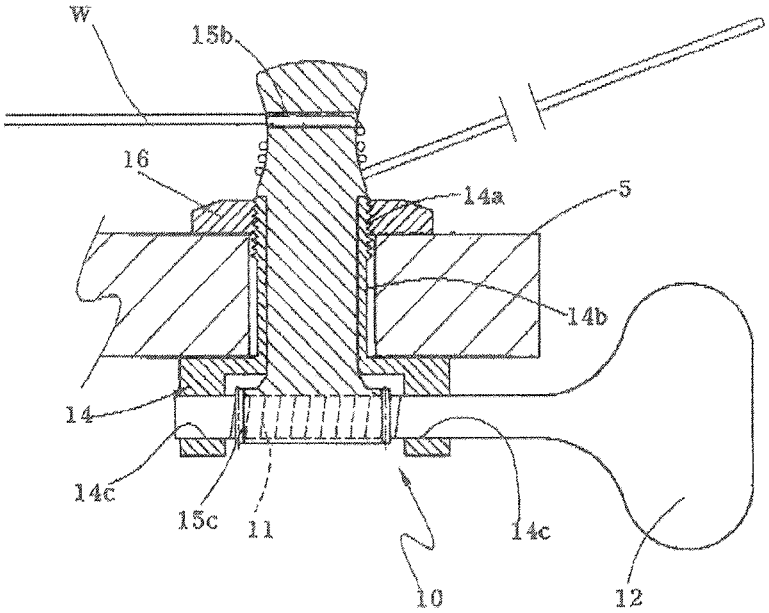
FIG. 3 is a vertically sectional view of the guitar string regulator according to the prior art.
Figure 4:
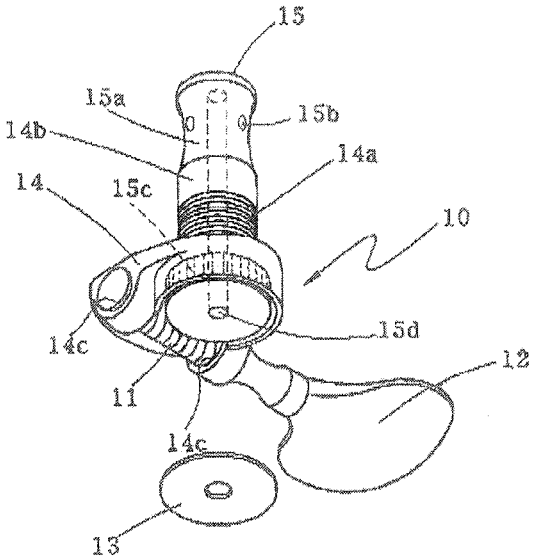
FIG. 4 is a perspective view of a guitar string regulator according to the present invention.

Referring to FIGS. 4 to 7, a guitar string regulator according to the present invention will be described in detail as follows.

A plurality of the guitar string regulators according to the present invention are mounted on a head of a guitar, and each of the guitar string regulators includes: a regulating lever 12 having a worm gear part 11 disposed at one side thereof; a casing 14 having a joining tube 14*b*, which has a male screw portion 14*a* penetrating through the head 5, and a bearing portion 14*c* formed on a lower portion thereof for receiving the worm gear part 11 and supporting rotation of the worm gear part 11; a rotational rod 15 penetrating through the casing 14 and having a winding portion 15*a*, which is concavely formed at one side thereof for winding a string, a guide hole 15*b*, which is formed in the winding portion 15 and penetrates through the joining tube 14*b* for inserting the string W thereinto, and a spur gear 15*c*, which is disposed at a lower portion thereof for rotating the rotational rod 15 in engagement with the worm gear part 11; and a nut 16 joined to the male screw portion 14*a* of the casing 14 for fixing the casing 14 from the head 5.

The rotational rod 15 has a through hole 15*d* formed at the center of the rotational rod 15 for inserting the remainder of the string W wound on the winding portion 15*a* thereinto.

The through hole 15*d* is twice the diameter of the guide hole 15*b* such that the remainder of the string W inserted into the through hole 15*d* is intersected relative to the string W inserted into the guide hole 15*b* of the winding portion 15*a*.

In the drawings, unexplained reference numeral 14 designates a stopper for stopping the bottom of the case 14.

Now, how to set the string and arrange the remainder of the string using the guitar string regulator will be described.

Referring to FIG. 1, a ring-shaped end of a string W is first connected to a bridge 3 of a guitar 1, and then, the other end of the string is set to the guitar string regulator 10 disposed on the head 5 of the guitar after passing through the fingerboard 4.

Figure 5:
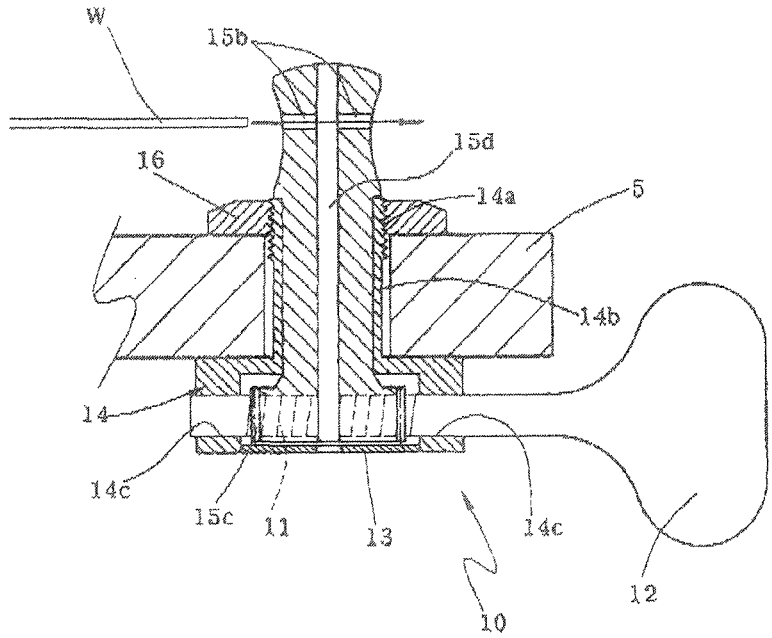
FIGS. 5 to 7 are vertically sectional views showing a used state of the guitar string regulator according to the present invention.

The above is the same as the guitar string regulator according to the prior art. After that, as shown in FIG. 5, the string W penetrates through the guide hole 15*b* of the rotational rod 15, and then, the regulating lever 12 is rotated in a state where a player holds the string passing through the guide hole 15*b* with the hand.

The worm gear part 11 mounted on the bearing portion 14*c* of the case 14 is geared with the spur gear 15*c* of the rotational rod, and then, the string W is wound on the winding portion 15*a* in a state where tension force is applied to the string while the rotational rod 15 is rotated.

In this instance, the rotational rod 15 is rotated inside the joining tube 14*b* of the case 14.

For your reference, the joining tube 14*b* is joined to the male screw portion 14*a* through the head 5 by the nut 16 so that the case 14 is firmly fixed to the head 5. Here, only the rotational rod 15 is rotated inside the joining tube 14*b* so that the string W can be wound in one direction so as to wind up the string W on the winding portion 15*a* more tightly. In this instance, when the string W is wound on the winding portion 15*a* from the guide hole, the string penetrating through the guide hole 15*b* and the string wound on the winding portion once are crossed.

Figure 6:
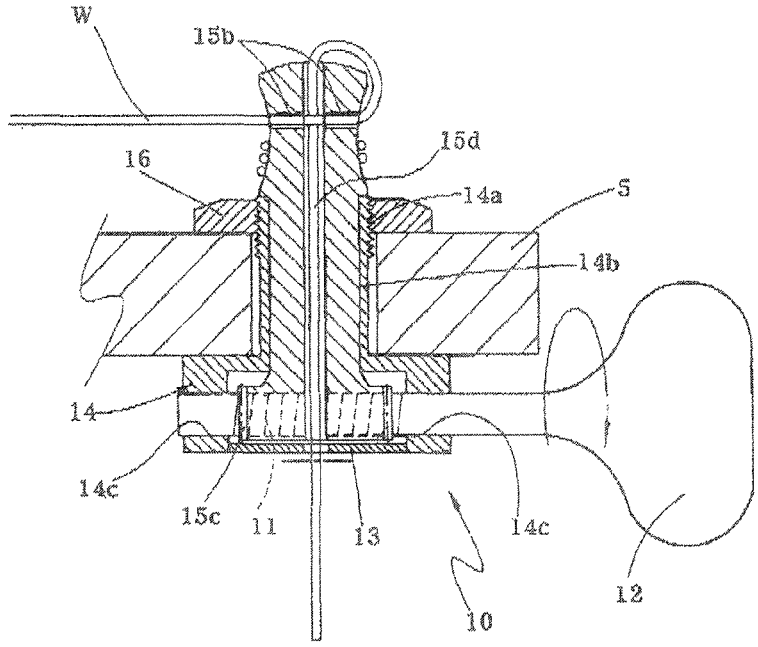

Finally, after six strings are arranged as the above before tones of the strings W are tuned, as shown in FIG. 6, the remainder of the string is inserted into the through hole 15*d* of the rotational rod 15 till completely passing through the through hole 15*d*.

Figure 7:
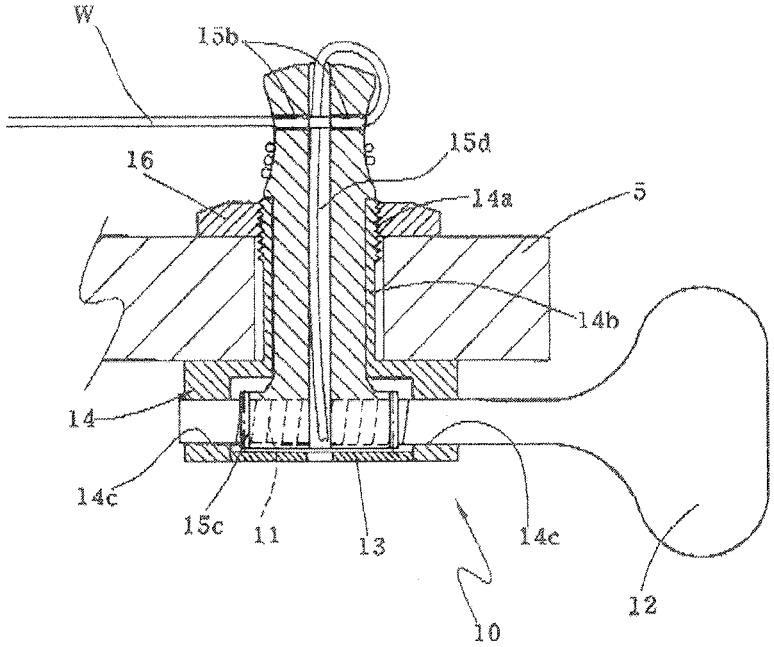

As described above, when the string passing through the lower portion of the rotational rod 15, namely, through the center of the spur gear, is cut close beneath the spur gear 15*c* using a nipper (not shown) in a state where the string is pulled as much as possible, as shown in FIG. 7, the end portion of the string W keeps the state where it is inserted into the through hole 15*d* by elasticity.

The string W arranged as the above is arranged more neatly in external appearance by the stopper 13 mounted on the bottom of the case 14.

Accordingly, because the end portions of the strings W are all arranged neatly, the guitar string regulator according to the present invention can prevent interference by the strings protruding roughly like the traditional way and prevent the player from getting pricked or scratched by the sharp end portion of the strings while the player handles the guitar.

The invention claimed is:

1. A plurality of guitar string regulators, which are mounted on a head of a guitar, each of which includes:

a regulating lever (12) having a worm gear part (11) disposed at one side thereof; a casing (14) having a joining tube (14*b*), which has a male screw portion (14*a*) penetrating through the head (5), and a bearing portion (14*c*) formed on a lower portion thereof for receiving the worm gear part (11) and supporting rotation of the worm gear part (11); a rotational rod (15) penetrating through the casing (14) and having a winding portion (15*a*), which is concavely formed at one side thereof for winding a string, a guide hole (15*b*), which is formed in the winding portion (15) and penetrates through the joining tube (14*b*) for inserting the string (W) thereinto, and a spur gear (15*c*), which is disposed at a lower portion thereof for rotating the rotational rod (15) in engagement with the worm gear part (11); and a nut (16) joined to the male screw portion (14*a*) of the casing (14) for fixing the casing (14) from the head (5), wherein the rotational rod (15) has a through hole (15*d*) formed at the center of the rotational rod (15) for inserting the remainder of the string (W) wound on the winding portion (15*a*) thereinto.

2. The guitar string regulator according to claim 1, wherein the through hole (15*d*) is twice the diameter of the guide hole (15*b*) such that the remainder of the string (W) inserted into the through hole (15*d*) is intersected relative to the string (W) inserted into the guide hole (15*b*) of the winding portion (15*a*).

* * * * *